US005365300A

United States Patent [19]

Wernicke et al.

[11] Patent Number: 5,365,300

[45] Date of Patent: Nov. 15, 1994

[54] METHOD FOR PROCESSING PHOTOGRAPHIC MATERIALS

[75] Inventors: Ubbo Wernicke, Rösrath-Kleineichen; Viktor Osegowitsch, Taufkirchen; Wilfried Hehn, Munich, all of Germany

[73] Assignee: Agfa Gevaert Aktiengesellschaft, Leverkusen, Germany

[21] Appl. No.: 833,995

[22] Filed: Feb. 11, 1992

[30] Foreign Application Priority Data

Feb. 26, 1991 [DE] Germany ..... 4105917

[51] Int. Cl.[5] ..... G03D 3/08

[52] U.S. Cl. ..... 354/320

[58] Field of Search ..... 354/320, 323, 324, 321, 354/322

[56] References Cited

U.S. PATENT DOCUMENTS 5,040,013 8/1991 Kurokawa et al. ..... 354/324 X 5,168,297 12/1992 Wernicke ..... 354/324

*Primary Examiner*—D. Rutledge

*Attorney, Agent, or Firm*—Connolly & Hutz

[57] ABSTRACT

A process for the treatment of a photographic material with a bath containing at least one processing chemical, in which, after the treatment bath, the photographic material is guided upwards through a sloping compartment which closely surrounds the photographic material and is washed from above with water which, under the effect of gravity, flows in countercurrent to the photographic material, leads to a surprisingly marked reduction in the chemical load of the material.

2 Claims, 2 Drawing Sheets

METHOD FOR PROCESSING PHOTOGRAPHIC MATERIALS

BACKGROUND OF THE INVENTION

Photographic processing methods are normally continuous. Accordingly, the photographic processing baths, for example development baths, bleaching baths, fixing baths, stop baths, stabilizing baths or bleaching-/fixing baths, have to be constantly regenerated in accordance with the quantity of photographic material to be processed to ensure that the concentration of processing chemicals is kept at the required level. Since, in most photographic processing steps, chemicals are released from the material into the processing bath and can cause problems through accumulation, the regenerating solution is added in a quantity which is larger than that which the material transports from the bath in any event, so that an overflow is formed. Both for economical and for ecological reasons, this overflow is collected, cleaned, chemically worked up and returned to the system.

To minimize losses of chemicals, it is standard practice to free the photographic material from adhering liquid before it leaves the chemical tank. Different methods are used for this purpose, including for example rubber lips ("wipers") lying on one or both sides of the material, vacuum extraction or blowing off with compressed air. With optimal settings and geometric adaptation, all three processes have an efficiency of at most 50 to 70%. In none of the processes mentioned are the chemicals which do not adhere to the surface of the material, but are present in the emulsion layers, removed or prevented from being carried over. Accordingly, there are significant losses of chemicals which are only removed from the material in the following washing stages and enter the wastewater.

The problem addressed by the present invention was quantitatively to prevent such losses and hence to enable photographic processing baths to be almost completely recycled.

It is known from DE-A-4 011 613 that the chemicals carried over from the chemical baths can be collected by subsequent washing in a multiple-compartment system and that the liquid accumulating in certain compartments can be concentrated by reverse osmosis or concentration by evaporation and subsequently returned to the circuit. This process is complicated in terms of procedure and equipment and lacks efficiency because the waters laden with chemicals always flow out from the middle compartment of three or five compartments.

DESCRIPTION OF THE INVENTION

Figure 1:
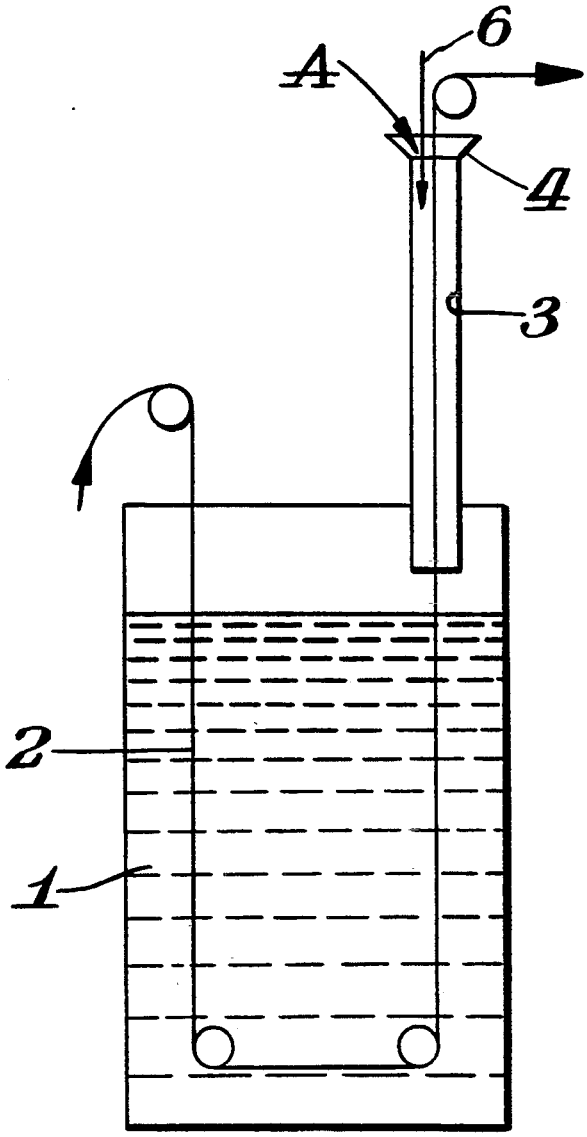
FIG. 1 is a vertical sectional view of an embodiment of the present invention.
Figure 2:
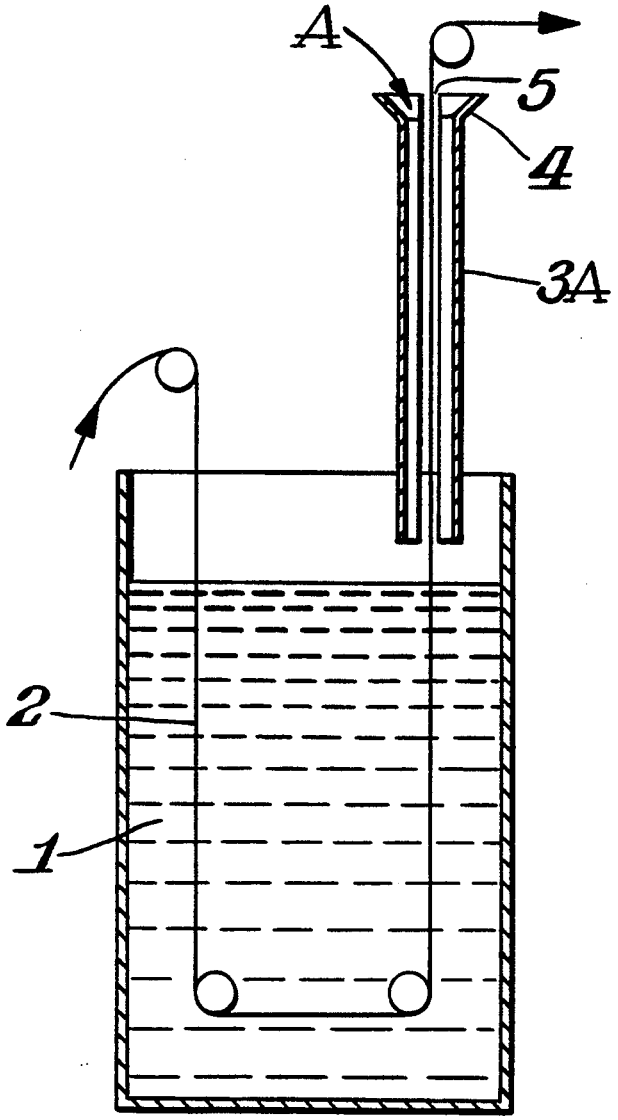
FIG. 2 is a cross-sectional side elevational view of an alternative embodiment of the present invention.

As illustrated in FIG. 1, the solution to the problem of avoiding the disadvantages of the prior art cited above is characterized in that, after the treatment bath, 1 the photographic material 2 is guided upwards through an upward extending compartment 3 which closely surrounds the photographic material and is washed from above with water added at point 1 which, under the effect of gravity, flows in countercurrent 6 to the photographic material. The compartment, ideally a preferably vertical tube adapted in its diameter to the geometry of the photographic material, may either dip into or, preferably, terminate just above the treatment liquid.

The compartment 3 has a volume of 1,000 to 5,000 $cm^3$ per $m^2$ material present therein. The extending upwardly compartment preferably has a constant diameter over its length. Its length is adapted to the transport speed of the material in such a way that a time in the compartment 3 of 6 to 60 s is obtained. For a transport rate of 1 m/min., the compartment should have a length of 10 to 100 cm. In a preferred embodiment, the compartment 3A has no side walls adjacent to the edges of the material 2. This side opening 5 enables the film 2 to be threaded easily.

In the case of a high-speed machine and if the height available is not sufficient to accommodate a compartment 3 of the required length, the compartment may be staggered and may be arranged adjacent the tank containing the processing chemicals, the water used being returned to the requisite level by pumping.

In one simplified embodiment which still reliably solves the problem stated above, the side walls of the compartment 3 which come closest to the edges of the material can be dispensed with. This makes threading of the material particularly easy. By covering the two remaining walls, for example with a foam, there is no danger of the water applied issuing laterally from the now open compartment 3 because it is kept inside the compartment 3 by surface tension or by capillary forces.

According to the invention, the water now laden with chemicals passes from the compartment 3 into the chemical tank above which it is arranged. The resulting dilution of the chemical bath is reversed by addition of the chemicals required to regenerate the bath 1 in concentrated form either as a liquid concentrate or even as a solid. In addition, the dilution may be reversed by permanently connecting the chemical bath itself to a concentration unit, for example an evaporator, a reverse osmosis unit or an ultrafiltration unit, through which part of the chemical bath is constantly passed.

The insides of the washing compartment 3 are advantageously lined with a material which does not damage the surface of the photographic material, for example foam, polyamide plush, polyamide netting, polypropylene plush, polypropylene cloth, stainless steel gauze or finely perforated stainless steel plate. The lined surface preferably faces the emulsion side of the material. The space between the lining materials and the wall of the compartment may be filled with capillary-active substances, such as cellulose fibers or silica gel.

The process according to the invention operates extremely efficiently when, per square meter photographic material, a 10 μm emulsion layer is wetted with 10 to 400 ml water, preferably with 50 to 200 ml water and, more preferably with 75 to 150 ml water. This value changes accordingly for photographic materials having other layer thicknesses.

EXAMPLE 1

10 $m^2$ of a standard color negative paper were exposed, developed, bleached and fixed, a stop bath and a first washing bath being provided between the development and bleaching baths, a second washing bath being provided between the bleaching and fixing baths and a third washing bath being provided after the fixing bath. The bleaching bath had a concentration of 112 g of the iron/ammonium complex salt of ethylenediamine tetraacetic acid ($NH_4$ Fe EDTA). After the bleaching bath, the material was stripped in the usual way by rubber lips. In contrast to the standard method, the color paper—after the bleaching bath—passed through an 8 liter washing tank to which no fresh water was added during processing. After processing of the 10 $m^2$ of color negative paper, the concentration of $NH_4$ Fe EDTA in this washing stage was determined to evaluate the effectiveness of the stripping lips.

A concentration of 8.2 g $NH_4$ Fe EDTA/l was determined by analysis.

EXAMPLE 2 (Invention)

The procedure was as in Example 1, except that, after passing through the bleaching bath tank and the rubber lips, the 8.9 cm wide photographic material was guided at a rate of 1 m/minute through a 60 cm long tube with an internal diameter of 3 mm and a width of 10 cm which had been lined with a polypropylene cloth. The tube was arranged vertically above the bleaching bath and did not dip into the bleaching bath, terminating 5 cm short of the bleaching bath. A quantity of 70 ml water per $m^2$ color paper was introduced at the upper end of the tube. Thereafter, the paper again passed through the 8 liter washing tank which was not topped up with fresh water. After processing of 10 $m^2$ paper, the concentration of $NH_4$ Fe EDTA was again analytically determined in this washing stage: 410 mg/l. Accordingly, the process according to the invention is 20 times more effective than the conventional stripper.

EXAMPLE 3 (Invention)

The procedure is as in Example 2, except that the 8.9 cm wide photographic material is guided between two parallel plates 60 cm long and 10 cm wide. The plates are lined with 1.5 mm thick foam on that side facing the photographic material. The material contacts both plates or rather the foam.

As in Example 2, the efficiency of the compartment was determined through the concentration of $NH_4$ Fe EDTA in the following washing stage: 470 mg/l.

We claim:

1. In a process for the treatment of a photographic material, the steps comprising, first, treating a photographic material with a bath containing at least one processing chemical, and then guiding the treated material in an upwardly movement through an upwardly extending compartment having a volume of 1000 to 5000 $cm^3$ per $m^2$ of the material present within the compartment to closely surround said treated material, said. Upwardly extending compartment terminating above the bath and washing the material moving upwardly in the compartment with water flowing under the effect of gravity of a downwardly movement countercurrent to the movement of the material.

2. In a process for the treatment of a photographic material, the steps comprising, first, treating a photographic material with a bath containing at least one processing chemical, and then guiding the treated material in an upwardly movement through an upwardly extending compartment having a volume of 1000 to 5000 $cm^3$ per $m^2$ of the material present, said compartment having openings extending the length of the compartment at each edge of the passing material, and washing the material moving upwardly in the compartment with water flowing under the effect of gravity in a downward movement counter to the movement of the material.

* * * * *